United States Patent [19]

Kneisel

[11] Patent Number: 4,862,665

[45] Date of Patent: Sep. 5, 1989

[54] ROOF PLANKING WITH MULTI BEADED GASKET STRIP

[76] Inventor: Joseph P. Kneisel, 1630 Carver St., Redondo Beach, Calif. 90278

[21] Appl. No.: 226,829

[22] Filed: Aug. 1, 1988

[51] Int. Cl.[4] ..... E04D 3/361; E04D 3/3645

[52] U.S. Cl. ..... 52/539; 52/541

[58] Field of Search ..... 52/539, 541

[56] References Cited

U.S. PATENT DOCUMENTS

| | | | |
|---|---|---|---|
| 3,042,193 | 7/1962 | Wendt | 52/173 X |
| 3,626,439 | 12/1971 | Kneisel | 52/539 X |
| 3,693,305 | 9/1972 | Kneisel | 52/276 |
| 3,899,855 | 8/1975 | Gadsby | 52/539 X |
| 3,905,165 | 9/1975 | Kneisel | 52/276 X |

*Primary Examiner*—David A. Scherbel
*Assistant Examiner*—Anthony W. Williams
*Attorney, Agent, or Firm*—Edgar W. Averill, Jr.

[57] ABSTRACT

An improved roofing material of the type which utilizes elongated planks nailed directly to the rafters. Each plank has a tongue along the upper edge and a groove along the lower edge. The improvement relates to the form of the gasket which has several beads along its length together with a thin layer or strip of wax approximately two inches wide is applied to the upper side of the tongue adjacent to where the gasket material will sit.

8 Claims, 1 Drawing Sheet

FIG. 1.
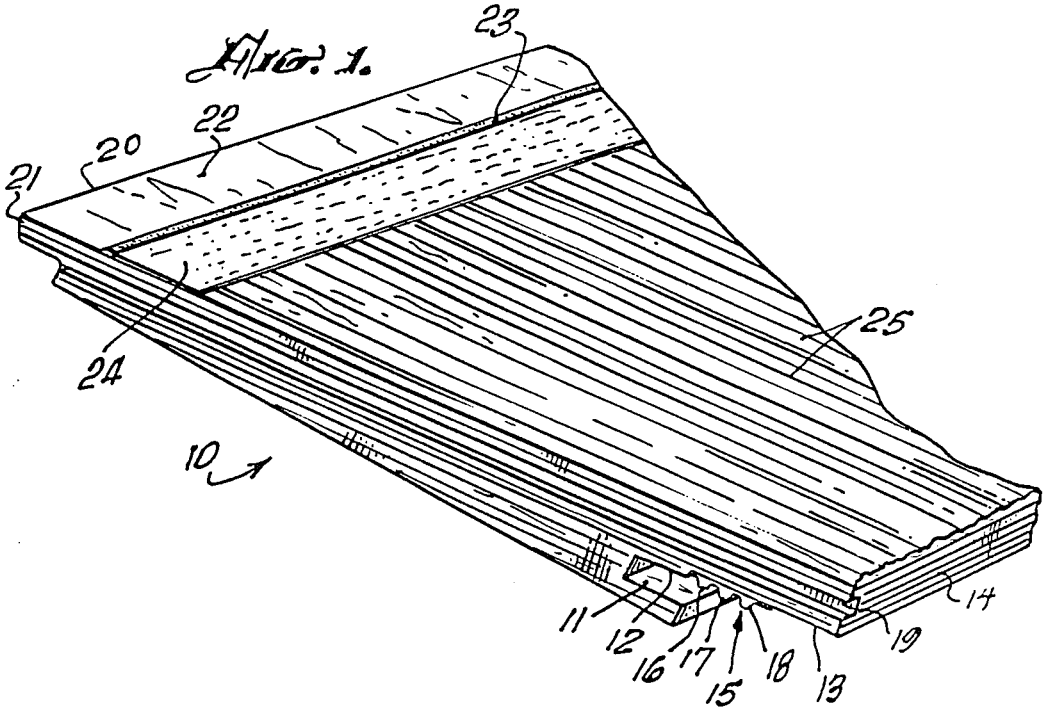
FIG. 2.
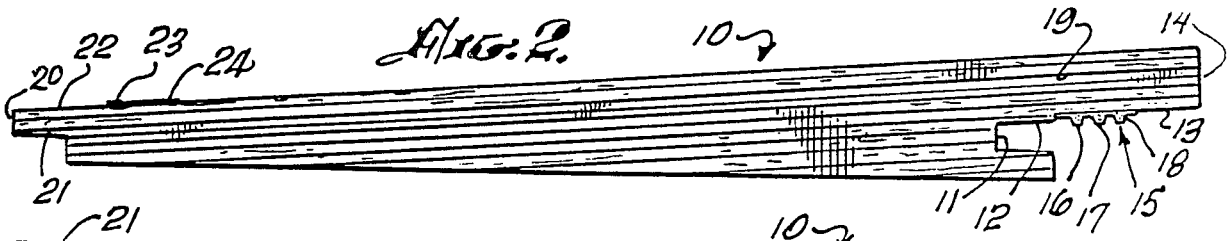
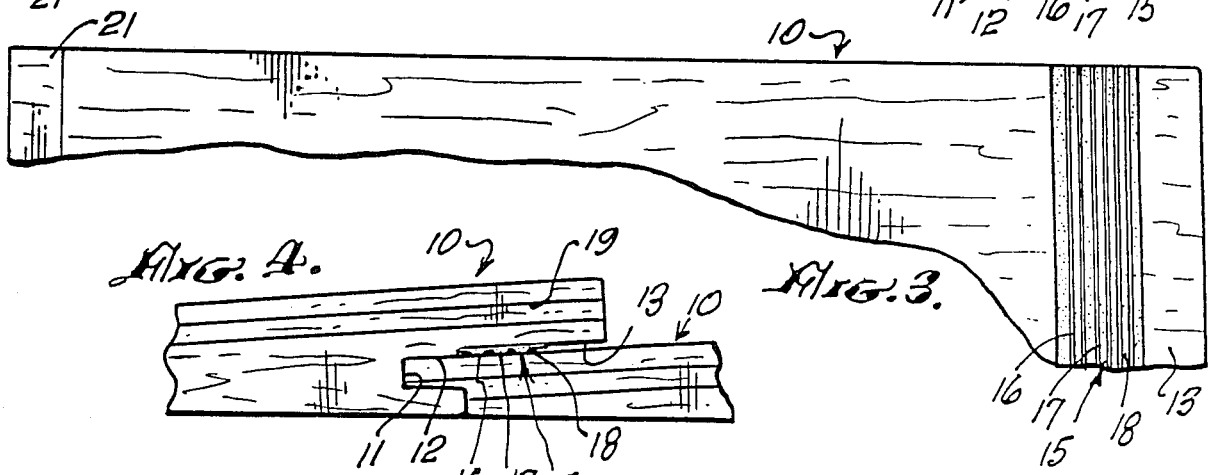
FIG. 3.
FIG. 4.
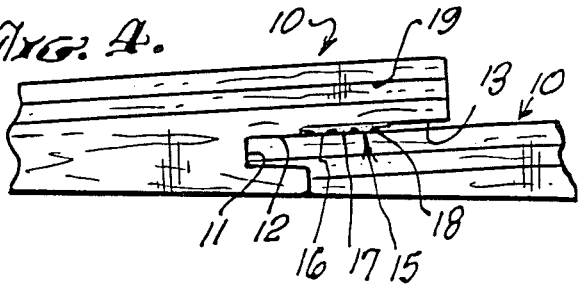
FIG. 5.
PRIOR ART
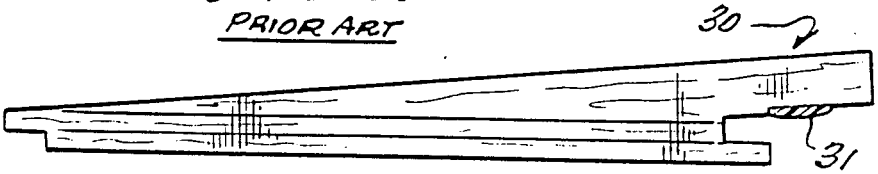

ROOF PLANKING WITH MULTI BEADED GASKET STRIP

BACKGROUND OF THE INVENTION

The field of the invention is roofing materials and the invention relates more particularly to a type of roofing material referred to as "roof planking" which is described in detail in applicant's U.S. Pat. Nos. 3,626,439; 3,693,305; and 3,905,165.

Although such roof planking is satisfactory, it was somewhat difficult to force an upper plank into its adjacent lower plank while still maintaining a leak-proof roofing because the distortion of the sealing, resilient material is too great. This becomes critical over such a wide band of sealing material.

SUMMARY OF THE INVENTION

It is an object of the present invention to provide roof planking gasket construction which facilitates the installation of the roof planking.

The present invention is for an improved roofing material of the type utilizing a plurality of elongated planks nailed directly on rafters. Each plank has a tongue along the upper edge and a groove along the lower edge which accepts the tongue of the adjacent lower elongated plank. The undersurface of the groove has a recess in which a gasket bead comprising a plurality of ridges is bonded. A thin layer of wax is applied to the upper surface of the tongue so that the groove of the upper plank can be easily slid in place without unnecessarily building up deformation of the gasket bead.

BRIEF DESCRIPTION OF THE DRAWINGS

FIG. 1 is a perspective view of one end of the improved roof planking of the present invention.

FIG. 2 is an end view of the improved roof planking of the present invention.

FIG. 3 is a bottom plan view thereof.

FIG. 4 is a side view showing the groove of an upper length of roof planking mated to the tongue of the lower length of roof planking.

FIG. 5 is a side view of the prior art roof planking.

DESCRIPTION OF THE PREFERRED EMBODIMENTS

One end of a length of roof planking 10 is shown in perspective view of FIG. 1. Roof planking 10 has a groove 11 which runs along the entire length of roof planking, and the upper surface 12 of groove 11 has a recess portion 13 which extends all the way to the front edge 14. An elongated gasket bead 15 has three ridges 16, 17 and 18, and gasket bead 15 extends the entire length of roof planking. The roof planking is typically four feet in length so that it may be easily handled by workmen. An edge groove 19 is used for sealing adjacent planks as set forth in applicant's U.S. Pat. No. 3,626,439. Roof planking of the type shown in applicant's U.S. Pat. No. 3,626,439 is shown in FIG. 4 of the present application and indicated generally by reference character 30. Planking 30 has a generally rectangular-shaped ridge of sealant 31 which has been replaced by the improved sealant described below.

The back edge 20 of roof planking 10 has a tongue 21 which fits into the groove of the adjacent plank of roof planking. The upper surface 22 of tongue 21 is smooth, and a nailing line 23 is marked further down the upper surface of roof planking to indicate where a nail should be driven. In this way, nails are not driven through the tongue or the base of the groove. A wax layer 24 is applied to the upper surface of roof planking 10 and extends from two inches from back edge 20 for a distance of about two inches. Wax layer 24 should be very thin, and it has been found that a layer of one-thousands on an inch is sufficient to facilitate installation. The wax layer abuts the three ridges 16, 17 and 18 during installation and eases the sliding of an upper length of roof planking onto its adjacent lower length. An embossed texture 25 comprising a plurality of irregular grooves is formed in the upper surface of roof planking 10 for aesthetic reasons.

The gasket bead is preferably extruded onto the recessed portion 13 and forms a sufficient bond so that it does not peel off during application.

As shown in FIG. 2, the grooves extend past the upper surface 12 of the groove and, thus, are deformed, as indicated in FIG. 4, after installation.

While three ridges have been shown in the drawings, it is within the purview of the present invention that two ridges, four ridges, or a plurality of ridges, could be used. The thickness of the ridges should be about one-eighth of an inch and they should be spaced about one-fourth of an inch apart. The depth of the recess should be about three-thirty seconds of an inch and the depth of the groove is about nine-sixteenths of an inch. The tongue which is about one-quarter of an inch thick thus forms a secure attachment to the adjacent length of roof planking.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved roofing material of the type utilizing a plurality of elongated planks nailed directly on rafters, each plank having a tongue along the upper edge, said tongue having an upper surface and a groove along the lower edge which accepts the tongue of the adjacent lower elongated plank and wherein said groove has an under surface and said under surface of said groove has a gasket bonded thereto wherein the improvement comprises:

a gasket bead comprising a plurality of ridges affixed to said under surface of said groove; and a thin layer of wax applied to said upper surface of said tongue along the line at which said gasket bead is placed when adjacent planks are joined.

2. The improvement roof planking of claim 1 wherein there are three ridges in said gasket bead.

3. The improved roof planking of claim 1 wherein said layer of wax is about one-thousands of an inch thick.

4. The improved roof planking of claim 2 wherein said groove has a recessed face thereon and said gasket bead is located in said recessed face, which recessed face is about three thirty-seconds of an inch thick and the thickness of said ridges is about one-eighth of an inch thick.

5. The improved roof planking of claim 4 wherein said gasket bead is extruded onto the surface of the recess.

6. The improved roof planking of claim 5 wherein said three ridges are spaced apart about one-fourth of an inch.

7. An improved roofing material of the type utilizing a plurality of elongated planks nailed directly on rafters, each plank having a tongue along the upper edge, said tongue having an upper surface and a groove along the lower edge which accepts the tongue of the adjacent lower elongated plank and wherein said groove has an under surface and said under surface of said groove has a recess of about three-thirty seconds of an inch deep, which recess has a gasket bonded thereto wherein the improvement comprises:

a gasket bead comprising three polysulfide ridges affixed to said under surface of said groove having a thickness substantially greater than three-thirty seconds of an inch; and a thin layer of wax applied to said upper surface of said tongue adjacent said gasket bead when adjacent planks are joined.

8. The improved roof planking of claim 7 wherein said ridges are about one-eighth of an inch thick.

* * * * *